US006603392B1

(12) United States Patent
Ramm

(10) Patent No.: US 6,603,392 B1
(45) Date of Patent: Aug. 5, 2003

(54) CONTROL CIRCUIT FOR AN ALARM TONE GENERATOR

(75) Inventor: Ross Richard Ramm, Carnegie (AU)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/647,044

(22) PCT Filed: Mar. 22, 1999

(86) PCT No.: PCT/DE99/00803

§ 371 (c)(1),
(2), (4) Date: Nov. 15, 2000

(87) PCT Pub. No.: WO99/49433

PCT Pub. Date: Sep. 30, 1999

(51) Int. Cl.[7] ..... G08B 3/00

(52) U.S. Cl. ..... 340/384.7; 340/384.1; 340/384.5

(58) Field of Search ..... 340/384.5, 384.7, 340/384.73, 384.1, 384.4, 384.71, 384.72; 116/24, 59, 137 R, 142 R

(56) References Cited

U.S. PATENT DOCUMENTS

| | | | | | |
|---|---|---|---|---|---|
| 3,707,716 | A | * | 12/1972 | Goralnick | |
| 3,758,855 | A | * | 9/1973 | Meyer | |
| 3,868,683 | A | * | 2/1975 | Darrow | 340/384 R |
| 3,971,016 | A | * | 7/1976 | Pui | |
| 4,940,929 | A | | 7/1990 | Williams | 323/222 |
| 4,970,451 | A | | 11/1990 | Suomalainen | 323/222 |
| 5,278,537 | A | | 1/1994 | Carlo et al. | 340/384.1 |
| 5,528,087 | A | * | 6/1996 | Sibata et al. | 323/224 |
| 6,081,184 | A | * | 6/2000 | Scollo | 340/384.73 |

* cited by examiner

*Primary Examiner*—Brent A. Swarthout
(74) *Attorney, Agent, or Firm*—Kenyon & Kenyon

(57) ABSTRACT

A driver circuit for an alarm tone transducer includes a signal generator for generating a first signal, a converter for converting the first signal into a second signal for the alarm tone transducer, a battery as a power supply for the circuit, and a circuit for raising the voltage to increase the voltage supply for the signal generator.

5 Claims, 1 Drawing Sheet

CONTROL CIRCUIT FOR AN ALARM TONE GENERATOR

FIELD OF THE INVENTION

The present invention relates to a driver circuit for an alarm tone transducer, in particular a driver stage, which can be used in vehicles containing an alarm tone system having an auxiliary battery.

BACKGROUND INFORMATION

Alarm tone systems in vehicles contain high-energy tone generators such as piezoelectric tweeters, horns, or loudspeakers, for emitting an audible alarm in response to different alarm or signaling (indicating) situations. These tone generators, which may be designated as alarm sirens or alarm tone transducers, are driven by a driver circuit which generates a drive signal for the siren. The driver circuits are supplied with current (power) by the vehicle battery, and the driver circuits additionally contain an auxiliary battery as emergency power supply in case the vehicle power supply to the warning system is interrupted.

A driver stage may use a tone transducer stage which includes a transformer, and which generates the signal for the alarm siren, and that is driven by a closed-loop control electronics. The voltage of the auxiliary battery, however, may dip to such an extent that it can no longer sufficiently supply the control electronics with power when the alarm siren works at maximum power. Therefore, it is desired to make a driver stage available which provides a sufficient emergency power supply without significantly increasing the cost of the circuit or which at least offers a usable alternative.

SUMMARY OF THE INVENTION

In connection with the exemplary embodiments of the present invention, a driver circuit is given for an alarm siren, the driver circuit containing the following units:

- a generator for generating a first signal,
- a converter for converting the first signal into a second signal for the siren,
- a battery for supplying the circuit with power, and
- a voltage amplifier for raising the supply voltage for the generator.

An exemplary embodiment of, the present invention concerns a driver circuit having a signal generator for generating the signal for the siren, and having a battery as power supply, the signal generator containing an inductance and a switch, in which a capacitor is connected to the inductance and to the switch, thereby resulting in a circuit for raising the voltage of the power supply.

DETAILED DESCRIPTION

Figure 1:
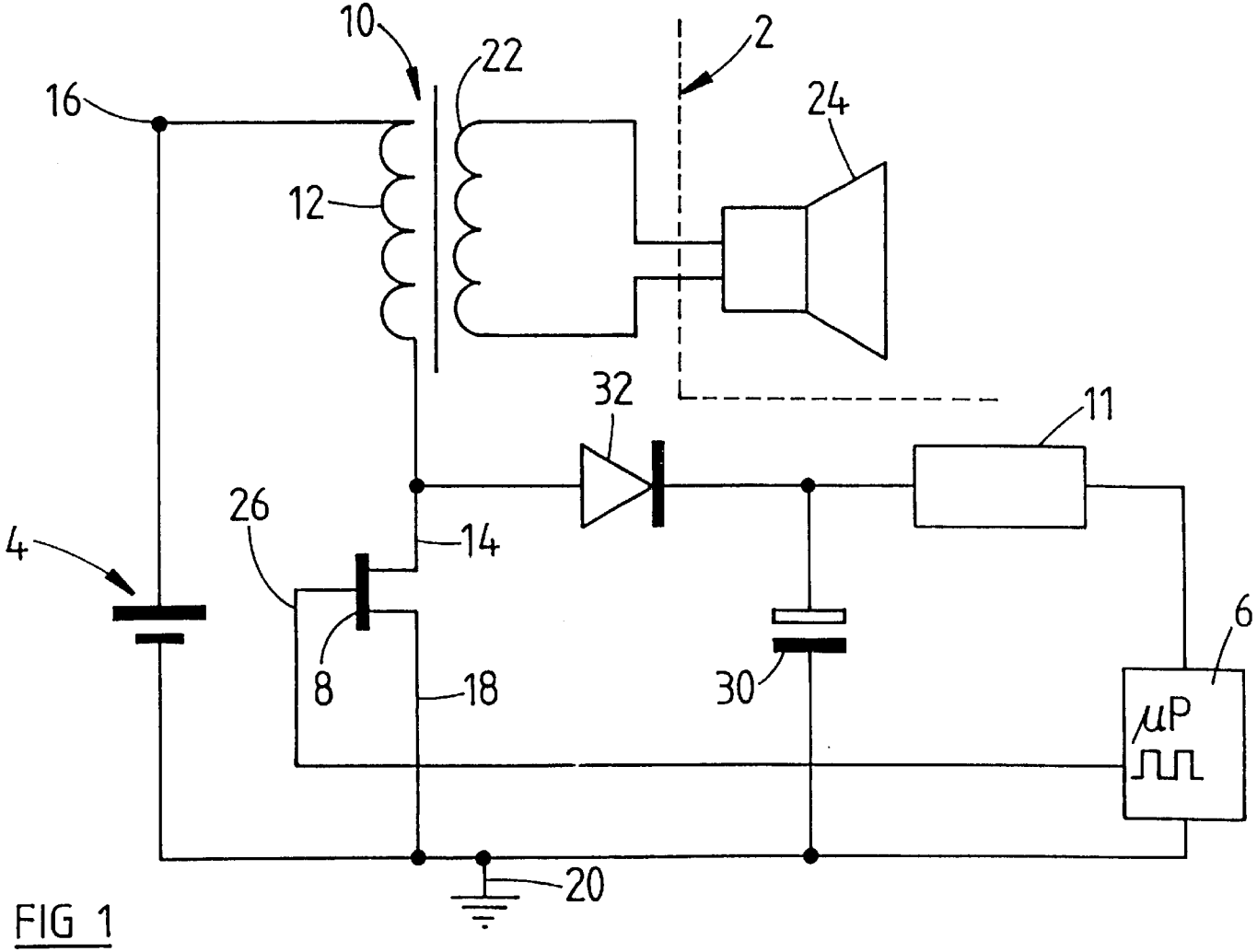
FIG. 1 shows a circuit diagram for an exemplary embodiment of a driver stage.

A driver circuit 2, as is shown in FIG. 1, contains an auxiliary battery 4, a microprocessor 6, a field-effect transistor (FET) 8, a transformer 10, and a voltage regulator 11. The primary winding 12 of transformer 10 is connected to drain 14 of FET 8 and to battery terminal 16. Source 18 of FET 8 is connected to ground 20, ground 20 being the vehicle ground. Battery terminal 16 is connected to the vehicle battery and also to auxiliary battery 4, which is connected between battery terminal 16 and ground 20. Secondary winding 22 of transformer 10 is connected to the contacts of a piezoelectric loudspeaker 24 which is driven by driver stage 2. Microprocessor 6 generates a frequency signal of a specific period which is applied to gate 26 of FET 8. The frequency signal switches FET 8 on and off so that current flows through primary winding 12, the current, in turn, inducing a signal in secondary winding 22 which is then applied to signal transducer 24.

When, the voltage supply of the microprocessor is provided using a voltage regulator which regulated the voltage coming from battery terminal 16, i.e. from the vehicle power supply or from auxiliary battery 4, during specific operating states of signal-tone transducer 24, for example, when the tone transducer is operated by processor 6 at maximum output power, voltage dips of auxiliary battery 4 may occur.

Compared with that, driver stage 2 receives a regulated voltage via the voltage present at 10 $\mu$F capacitor 30. Capacitor 30 is connected between ground and the cathode of a diode 32 whose anode is connected to drain 14 of FET 8. Moreover, the cathode of diode 32 is connected to the input of voltage regulator 11 which supplies a regulated voltage to the load constituted by microprocessor 6. Diode 32 prevents capacitor 30 from discharging again via FET 8. Diode 32 is connected in reverse direction so that capacitor 30 is isolated when FET 8 is enabled, and current and energy flows to primary winding 12. When FET 8 is disabled by the frequency signal originating from microprocessor 6, diode 32 is connected in a forward direction, as a result of which capacitor 30 is charged by the current from primary winding 12. The switching through and interrupting of the connection between capacitor 30 and winding 12 by FET 8 and diode 32 causes the voltage stored in capacitor 30 to be normally higher than the voltage across auxiliary battery 4. Capacitor 30, winding 12, FET 8, and diode 32, as are interconnected in driver circuit 2, consequently represent an amplifier which raises the voltage of auxiliary battery 4. Winding 12 is used both for driving tone transducer 24 and for charging capacitor 30.

Therefore, driver circuit 2 is believed to be particularly advantageous because by raising the voltage supply for regulator 11 of microprocessor 6, an auxiliary battery 4 having a lower capacity should be sufficient. For example, where formerly a 7.2 V 240 mAh cell was necessary, now a 7.2 V 160 mAh cell is sufficient for operating circuit 2, which is believed to constitute a considerable cost reduction. Moreover, no additional component parts are necessary since a voltage regulator for the microprocessor would normally contain diode 32 and capacitor 30 in any case. Only the capacity of capacitor 30 possibly needs to be increased so that the raised voltage can be sustained.

Driver circuit 2 can also be used for other tone transducers in other environments where battery 4 is used as the only power supply. The driver circuit could be used, for example, in a portable alarm device.

What is claimed is:

1. A driver circuit for an alarm tone transducer, comprising:

- a signal generator for generating a first signal;
- a converter for converting the first signal into a second signal for the alarm tone transducer;
- a battery for use as a power supply for the driver circuit; and
- an amplifier circuit arrangement for providing a voltage to increase a voltage supply for the signal generator;

wherein the converter includes an inductance arrangement, the amplifier circuit arrangement includes a capacitor coupled to a coil of the inductance arrangement, the converter includes a switch coupled to the inductance arrangement, the switch being switched on and off by the first signal, and wherein the battery is coupled in parallel with a series coupling of the inductance arrangement and the capacitor, the capacitor being coupled in parallel with the switch.

2. The driver circuit of claim 1, wherein the amplifier circuit arrangement includes a diode coupled between the capacitor and the switch so that the capacitor does not discharge via the switch.

3. The driver circuit of claim 2, further comprising a voltage regulator for providing a voltage for the signal generator, wherein the capacitor is coupled to an input of the voltage regulator.

4. The driver circuit of claim 3, wherein the signal generator includes a microprocessor.

5. The driver circuit of claim 4, wherein the switch includes a transistor.

* * * * *